US006732687B2

(12) United States Patent
Djordjevic

(10) Patent No.: US 6,732,687 B2
(45) Date of Patent: May 11, 2004

(54) LASH ADJUSTER WITH LOCKING BALLS DEACTIVATION

(75) Inventor: Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/386,784

(22) Filed: Mar. 12, 2003

(65) Prior Publication Data

US 2003/0172889 A1 Sep. 18, 2003

Related U.S. Application Data

(60) Provisional application No. 60/364,273, filed on Mar. 13, 2002.

(51) Int. Cl.[7] ..... F01L 1/34

(52) U.S. Cl. ..... 123/90.16; 123/90.12; 123/90.15; 123/90.46; 123/90.55; 123/198 F

(58) Field of Search ..... 123/90.16, 90.12, 123/90.15, 90.27, 90.31, 90.43–90.49, 90.52, 90.55, 90.57, 198 F

(56) References Cited

U.S. PATENT DOCUMENTS 5,372,114 A * 12/1994 Gant et al. ..... 123/502
6,192,841 B1 * 2/2001 Vorih et al. ..... 123/90.12
6,196,175 B1 * 3/2001 Church ..... 123/90.16

* cited by examiner

*Primary Examiner*—Thomas Denion
*Assistant Examiner*—Kyle Riddle
(74) *Attorney, Agent, or Firm*—Alix, Yale & Ristas, LLP

(57) ABSTRACT

A generally conventional lash adjuster is modified by incorporating a coaxially oriented hydraulic control piston assembly within the guide body. The control piston normally fixes latch means, such a plurality of hard spheres, in multiple detents loaded in compression with the other components, to provide a rigid stop, but when the control piston is hydraulically pressurized, the detents are overcome and the piston assembly provides a resilient or soft stop that accommodates extended displacement (retraction) of the lash adjuster within the guide. The hydraulic actuation is preferably implemented with a three-way solenoid valve or the like, for controlling high-pressure oil to a gallery and associated inlet ports for the control piston assembly. In the typical implementation of the invention, the piston need have only two operational positions-denergized to establish the detent or hard stop condition, or fully energized to establish the valve deactivation position. With all of preferably four detents in quadrant symmetry and associated components in compression, side loading is avoided. Moreover, with the present invention, backlash is also avoided.

18 Claims, 8 Drawing Sheets

LASH ADJUSTER WITH LOCKING BALLS DEACTIVATION

This is the regular application, claiming priority under 35 USC §119(e) of U.S. Provisional Application No. 60/364,273 filed Mar. 13, 2002.

BACKGROUND

The present invention relates to hydraulic lash adjusters for internal combustion engines.

Automobile engines use only a small fraction of their rated power during most of the running time. It is known that increased fuel economy can be achieved by reducing the air pumping losses to the engine cylinder during steady state running, if in particular, some of the engine cylinders are deactivated while the other cylinders are kept active.

There are several ways to achieve this cylinder deactivation. One way is a collapsible hydraulic lash adjuster, whereby engine valves are selectively deactivated. A typical hydraulic lash adjuster is a very simple device, consisting basically of a hydraulic cylinder and piston assembly, mounted either in series or in parallel with the valve train. The working chamber of this lash adjuster is connected to the engine lube oil circuit via a one-way check valve. During the time while the engine valve stays open, the valve closing forces are supported exclusively by the column of lube oil trapped in the chamber. Because of the increased pressure level, some of the initial lube oil charge leaks out, shortening the valve train length and insuring proper seating of the valve. Once the valve is seated and the valve closing force is supported by the valve seat, the pressure in the chamber drops. The gap created by the leakage is then quickly refilled via the one-way (no return) valve from the lube oil circuit. By elimination of the gap there is no significant acoustic noise generated and any seat wear is compensated.

During the engine valve active cycle (valve open), collapsing of the lash adjuster piston assembly is prevented by a lateral latching pin, locked in a corresponding bore of the outer sleeve. During the de-activation cycle, lube oil from a secondary circuit pushes the latching pin out of engagement (against a reset spring) and the lash adjuster carrier, from that point on, will not be able to support the valve train forces and the valve will remain closed (and by that de-activated). The motion of the valve train generated by the cam is instead absorbed by the spring(s) mounted below the lash adjuster carrier.

The disadvantages of this design are, first, difficulties associated with the latching pin to find its target bore during the very short time available for re-activation (especially critical at higher speed) and, secondly, the high bending (shearing) forces the pin and its retaining bore are exposed to.

SUMMARY OF THE INVENTION

According to the present invention, the hydraulic lash adjuster is modified so that, upon receipt of a valve deactivation signal, the lash adjuster stop limit more reliably and consistently changes from a hard stop to a soft stop. As a result, the excess force stored in the valve closure spring, displaces the lash adjuster through the soft stop such that the tappet pivot point on the lash adjuster is also displaced to a position where the overhead cam acts with reduced force on the roller finger. Thus, the valve does not open during any portion of the cam shaft rotation. Upon denergization of the lash adjuster, the pivot point for the finger arm returns to the normal position, the lash adjuster encounters a hard stop, and the cam can overcome the valve closure spring to open the valve according to the cam timing.

In essence, a generally conventional lash adjuster is modified by incorporating a coaxially oriented hydraulic control piston assembly within the guide body. The control piston normally fixes latch means, such a plurality of hard spheres, in multiple detents loaded in compression with the other components, to provide a rigid stop, but when the control piston is hydraulically pressurized, the detents are overcome and the piston assembly provides a resilient or soft stop that accommodates extended displacement (retraction) of the lash adjuster within the guide. The hydraulic actuation is preferably implemented with a three-way solenoid valve or the like, for controlling high-pressure oil to a gallery and associated inlet ports for the control piston assembly. In the typical implementation of the invention, the piston need have only two operational positions-denergized to establish the detent or hard stop condition, or fully energized to establish the valve deactivation position.

With all of preferably four detents in quadrant symmetry and associated components in compression, side loading is avoided. Moreover, with the present invention, backlash is also avoided.

More particularly, during high power operation (engine valve active) a substantially cylindrical lash adjusting tappet insert is supported by a ring of balls located in one or more cross holes in the lower portion of the tappet body, engaging with a corresponding annular groove in the guide body bore. The hydraulic control piston is located on the centerline of the tappet body and, energized by its own return spring, keeps the balls spread apart so long as there is no pressurized oil present in the control gallery or chamber. All components supporting the valve actuation reaction forces are loaded in compression in a similar way to a ball bearing, which is very advantageous as far as wear and life expectancy are concerned.

Once the pressurized lube oil is switched on, hydraulic force will overpower the control piston return spring force and move the control piston in the downward direction, allowing the balls to slide down the ramp of the annular groove and by that move towards the center and release the tappet. In this position, the only force trying to push the tappet up is the force of the tappet return spring (deactivation spring) located in the lower portion of the tappet, which is much smaller than the force necessary for valve actuation and by that preventing opening of the associated engine valve.

In order to reduce the contact stress (Hertzian stress) at the most critical point, the upper portion of this hydraulic control piston is preferably shaped somewhat like a compound pyramid, defining four symmetric pairs of upper and lower ramps. Upon activation of the control piston, the balls move from support at the lower ramps to support at the upper ramps. At the same loads the contact stress between a ball and a flat is much smaller than the contact stress between a ball and a cylinder. Also the included angle of both ramps (lower and upper) can be designed in such a way as to minimize resulting reaction force at the ball/ramp interface. In a similar way the locking surfaces (lower ramp) of the control piston can have a small included (self-locking) angle to eliminate backlash during the valve active (balls engaged) period.

BRIEF DESCRIPTION OF THE DRAWINGS

The preferred embodiments of the invention will be described below with reference to the accompanying drawings, in which.

DESCRIPTION OF THE PREFERRED EMBODIMENT

Figure 1:
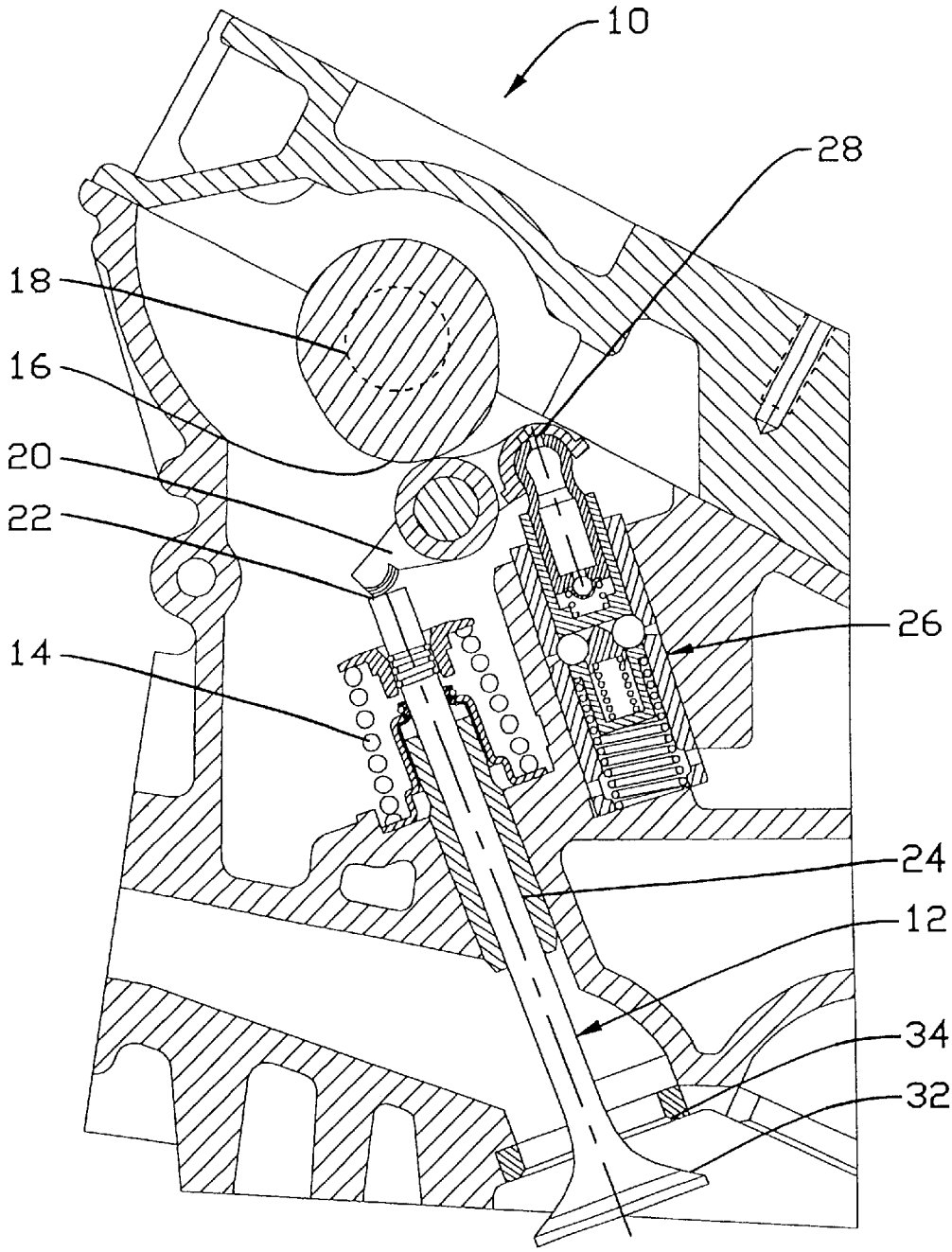
FIG. 1 is a partially sectioned view of a portion of an internal combustion engine, showing an exhaust valve opened against its valve spring by the force transmitted from a lobe on the cam shaft, through a pivotable finger arm to the sliding surface at the top of the valve stem, with the lash adjuster according to the invention configured in the normal, deactivated condition to provide a fixed pivot point at the other end of the finger arm.

FIG. 1 is a partially sectioned view of a portion of an internal combustion engine 10, showing an exhaust valve 12 opened against the valve spring 14 by the force transmitted from a high lobe 16 on the cam shaft 18, through a pivotable finger arm 20 to the sliding surface at the top 22 of the valve stem 24, with the lash adjuster 26 according to the invention configured in the normal, deactivated condition to provide a fixed pivot point 28 at the other end of the finger arm 20.

Figure 2:
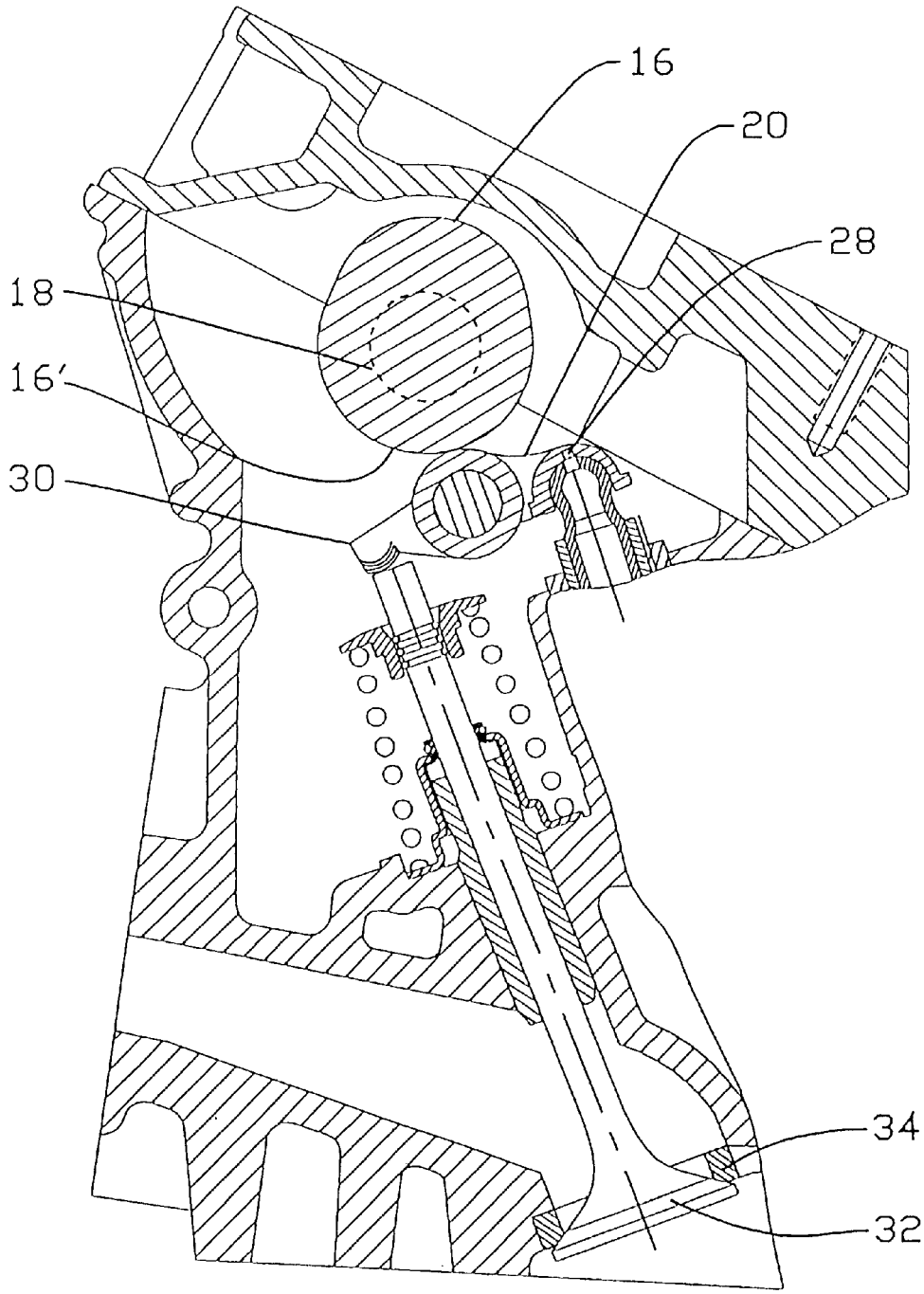
FIG. 2 is a view similar to FIG. 1, showing the cam shaft rotated to retract the lobe acting on the finger arm, whereby the free end pivots clockwise relative to the position shown in FIG. 1 about the normal fixed pivot point of the lash adjuster, such that the valve spring raises the valve stem and the valve member closes against the valve seat.

FIG. 2 is a view similar to FIG. 1, showing the cam shaft 18 rotated to retract the high lobe 16 so that the low portion 16' acts on the finger arm 20, whereby the free end 30 pivots clockwise relative to the position shown in FIG. 1 about the normal fixed pivot 28 point of the lash adjuster, such that the valve spring raises the valve stem and the valve member 32 closes against the valve seat 34.

Figure 3:
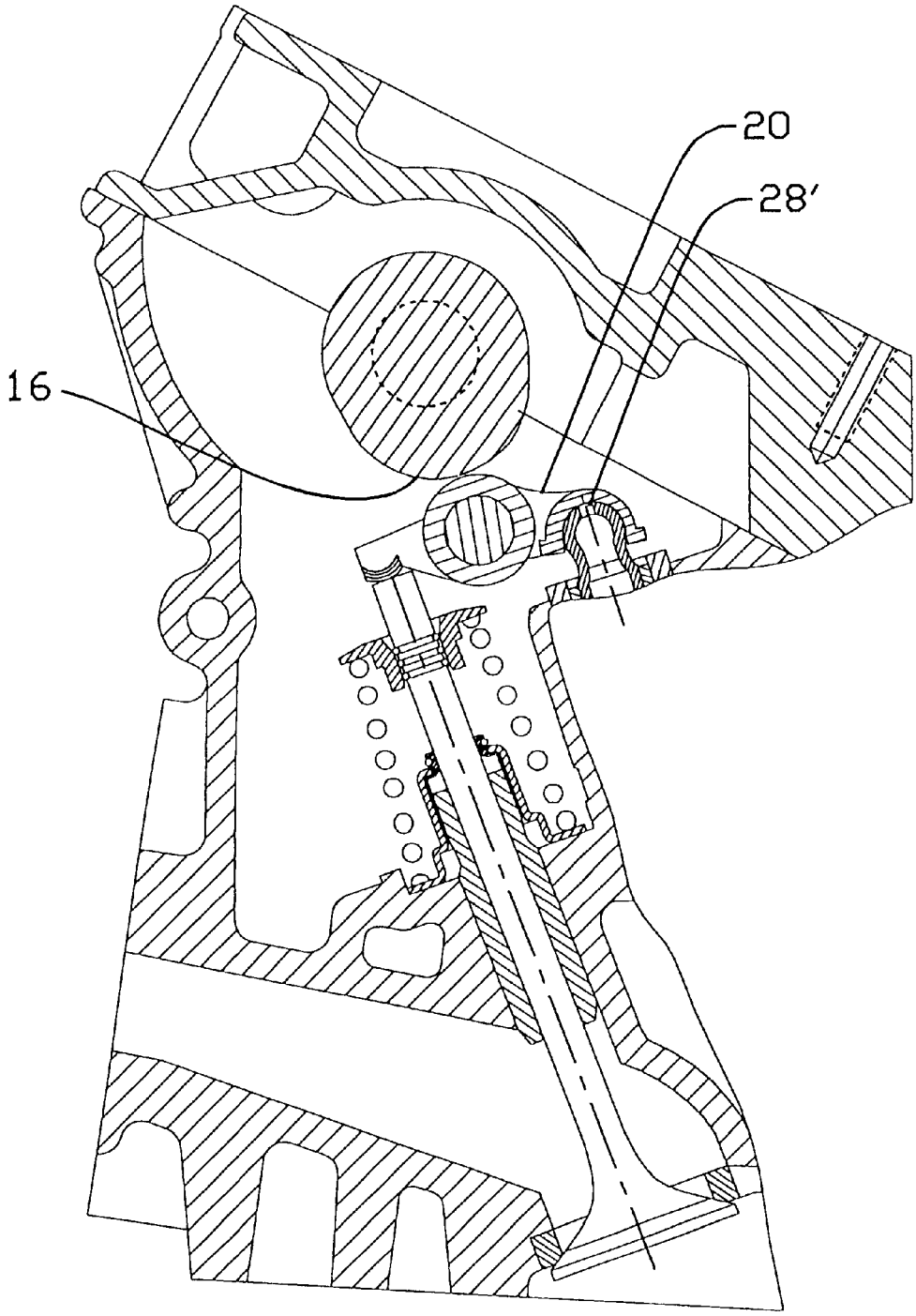
FIG. 3 is a view similar to FIG. 2, showing the result of activating the engine valve deactivation device (lash adjuster) according to the present invention, thereby lowering the finger arm pivot point such that even when the lobe portion of the cam engages the arm, the arm does not pivot sufficiently against the valve stem to open the valve.

FIG. 3 is a view similar to FIG. 2, showing the result of activating the lash adjuster according to the present invention, thereby retracting the finger arm pivot point 28' such that even when the high lobe portion 16 of the cam engages the arm 20, the arm does not pivot sufficiently against the valve stem 24 to open the valve 32.

Figure 4A:
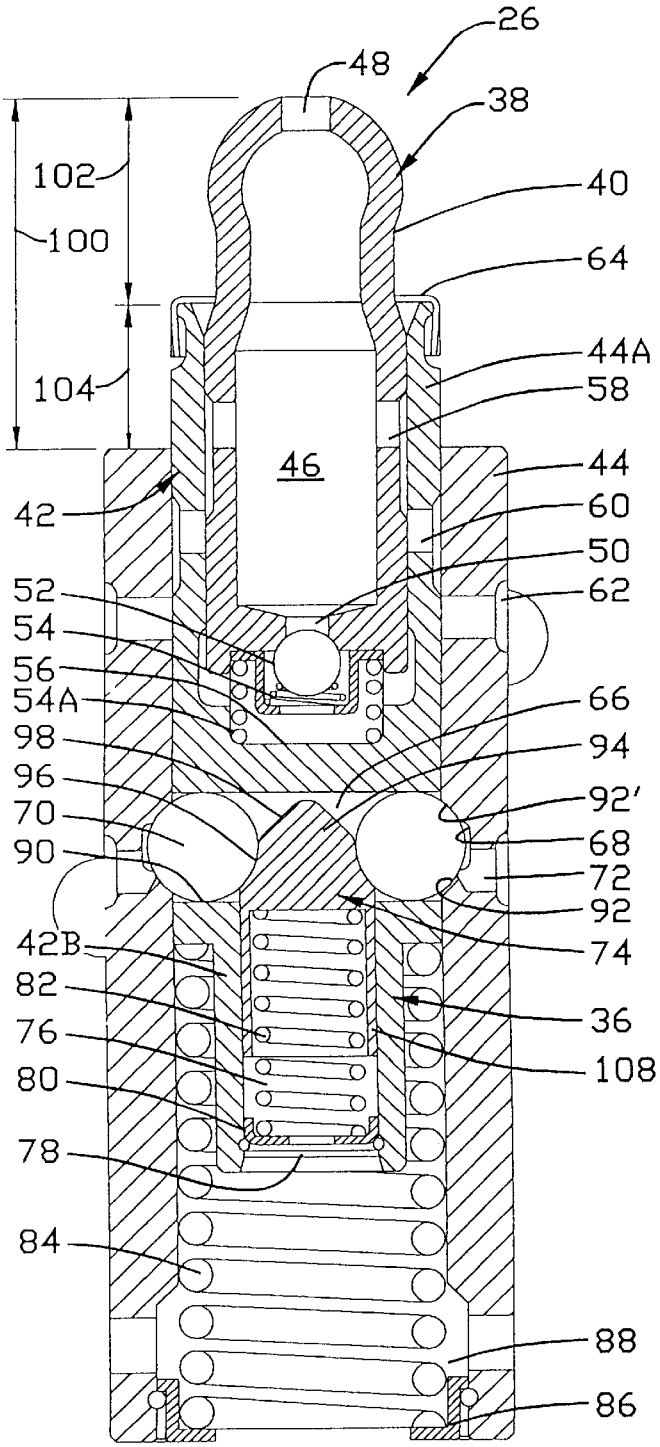
FIGS. 4A, B, and C show the lash adjuster modified according to the preferred embodiment of the invention with a compund-pyramid-like control piston, in the normal, "hard stop" configuration corresponding to FIGS. 1 and 2.

FIGS. 4A, B, and C show the lash adjuster 26 modified according to the preferred embodiment of the invention with a pyramid-like control piston assembly 36, in the normal, "hard stop" configuration corresponding to FIGS. 1 and 2. The lash adjuster 26 comprises a conventional main or primary piston assembly 38 and a secondary or control piston assembly 36 that are both situated within a guide body 44. In the illustrated embodiment, a unitary cylinder unit 42 functions as a tappet and defines both the primary cylinder 42A and the secondary cylinder 42B.

The main or primary piston assembly 38 comprises a first piston 40 situated within the primary cylinder 42A and operates in the conventional manner described in the Background. A primary hydraulic circuit provides hydraulic fluid from primary inlet gallery 62 and the associated port through the guide body 44, to port 60 in the first cylinder 42A for the purpose of adjusting the axial position of the primary piston 40 relative to the first cylinder 42A. As is conventional, the first piston 40 has a passage 50 normally closed by check valve 52 with associated ball spring and seat 54. The seat is urged against the base of the first piston 40 by another spring 54A supported by end wall 56. In the illustrated form the first piston has a hollow center 46 leading to a vent 48 in the head. Below the head, a narrower neck is captured within an aperture in sleeve 64, which is in turn fixed to the upper end of the first cylinder 42A.

In this manner, the projection of the first piston 40 from the top of the guide 44, indicated at 100, can be adjusted by adjusting the projection 102 of the first piston 40 relative to the first cylinder 42A.

According to the invention, the second piston assembly 36 is selectively actuated, by a second hydraulic circuit, for permitting a "soft" retracting the first piston assembly 38 within guide body 44, thereby decreasing the projection 104 of the cylinder 42A from the guide body 44. In the illustrated embodiment, where the first cylinder 42A and second cylinder 42B are integral with cylinder unit or tappet 42, displacement of the second piston assembly 36 also displaces the primary piston assembly and with it, the first piston 40. To the extent the second piston assembly 36 is displaced (retracted), or reaches a resilient end position, the first piston assembly likewise achieves a resilient retracted position within the guide 44.

When the cylinder unit 42 is in the retracted (activated) position the pivot point 28, shown in FIGS. 1 and 2, is displaced downward as shown at 28' in a FIG. 3, thereby altering the leverage as between the lobe 16 and the arm 20 such that the lobe cannot supply sufficient force on the arm to overcome the valve spring 14 and thereby open valve 32. With the invention, during the activated condition the pivot point with the cam position shown in FIG. 2 is the same as when the lash adjuster is deactivated, but with the cam position shown in FIG. 1 the "soft stop" moves the pivot point downward to the position shown in FIG. 3.

Figure 4B:
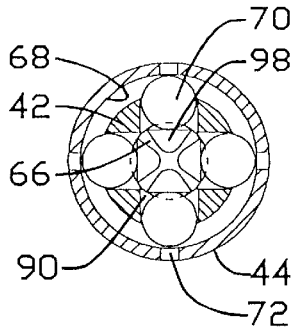
Figure 4C:
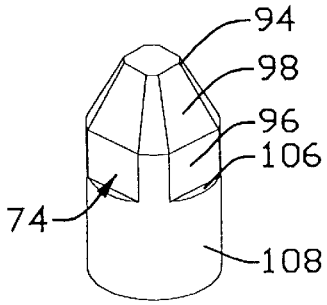

In the embodiments of FIG. 4, the cylinder unit 42 has a solid central region between piston cylinders 42A and 42B, except that two through bores intersect at right angles to form a hydraulic control gallery or chamber 66 immediately surrounding the centerline of the cylinder unit as well as forming four cylindrical slots for receiving a respective four rigid balls 70 having substantially the same diameter as the diameter of the cross bores. At the plane oriented transversely to the centerline and passing through the centers of the cross bores and balls 70 (i.e., as shown in FIG. 4B), the guide body 44 has a respective four arcuate detents 68, preferably formed by an annular groove along the inside surface of the guide body 44.

The balls 70 are supported in the bores at lateral positions such that the lower curvature on each detent forms a rigid stop 92 that maintains a fixed projection of the first cylinder 42A from the top of the guide body 44, as indicated at 104. The balls 70 are urged against the rigid stops 92 by the head 94 of the second, or control piston 74. In particular, the steep lower slope 96 and ledge 106 on the piston head 94, in combination with the upward bias of piston spring 82, keep the balls 70 in the latched position associated with the normal valve operation as explained above with respect to FIGS. 1 and 2.

The secondary piston assembly 36 has secondary cylinder 42B with open bottom 78 wherein the outer diameter of the second cylinder is less than that of the first cylinder 42A below the central region containing the cross bores. The portion 90 of the cylinder unit immediately below the cross bores not only defines a shelf or track at the lower bore wall on which the balls can be supported (as more fully described below), but also defines a shoulder or flange against which the cylinder spring 84 biases the cylinder unit upwardly. Whereas the lower curvature 92 of the detents provides a rigid stop preventing downward movement of the cylinder unit 42 relative to the guide body 44, in opposition to downward forces applied at the head of the first piston 40, the upper curvature 92' of the detents provides a rigid stop in opposition to the upward bias on the cylinder unit provided by the cylinder spring 84, which is seated 86 at the bottom of the cylinder unit 42.

When the latching components are released, as will be described more fully below, the cylinder spring 84 bears all the downward forces acting via the first piston 40 through the cylinder unit 42, and provide the desired provides soft (i.e., resilient) stop, whereby the combustion cylinder valve 32 remains closed throughout the camshaft rotation. The valve is thus "deactivated" when the second cylinder assembly 36 is "activated" in the following manner. Hydraulic fluid is introduced through the secondary inlet port 72 in the guide body 44, thereby passing through the annulus 68 at the inside wall of the guide body and pressurizing the secondary gallery or control chamber 66. This pressurization acts on the head 94 of the control piston 74, urging it downwardly against the bias of the piston spring 82, which is mounted in seat 80 at the lower end of the secondary cylinder 42B and which is also seated within the hollow body 108 of the piston. As the control piston moves downwardly within the piston chamber 76, the lower ramps 96 ride on the lower half of the balls, such that the balls remain substantially stationery. However, upon further movement of the control piston, the balls contact the upper slopes 98 which have a significantly less acute angle, whereby the balls move laterally inward, toward the centerline.

When the control piston is fully retracted within its cylinder 42B the balls have moved inwardly away from the detents such that, due to the high pressure in the control chamber 66, a downward force on the cylinder unit 42 (due to the cam lobe 16 acting via arm 20 on piston 40 per FIG. 1) causes of the balls to roll radially inwardly on the shelf 90 as the balls contact the inner wall of the guide body 44 below the detents 68. This downward movement of the cylinder unit 42 is now unrestricted by the balls and continues downwardly against the bias of spring 84 until (at the limit if necessary) the second cylinder 42B bottoms out at the lower end of the guide body 44. Port 88 vents the fluid in the lower portion of the guide body 44 volume.

Figure 5A:
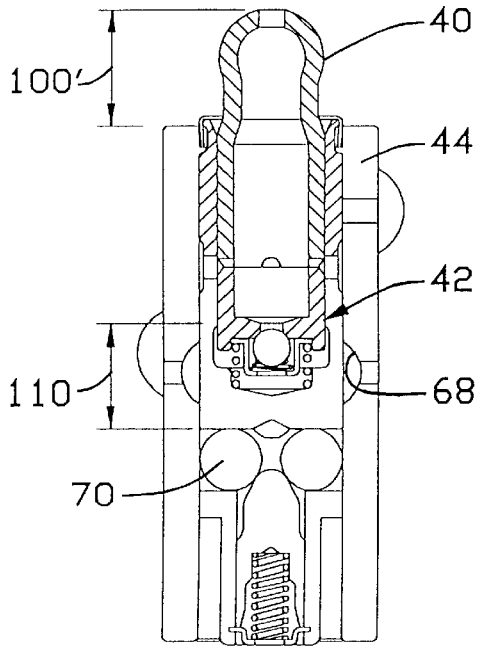
FIGS. 5A and B, show the lash adjuster of FIG. 4, in the activated, or "soft stop" configuration.
Figure 5B:
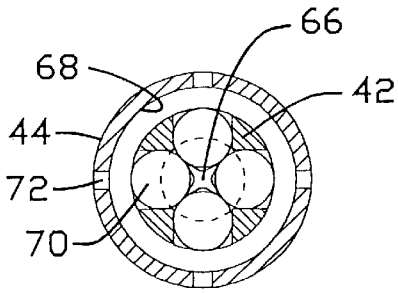

FIGS. 5A and B, show the lash adjuster at the retraction limit of the activated, or "soft stop" configuration. Whereas the section view in FIG. 4B shows the relationship of the balls 70 to the groove 68 in guide body 44, the control chamber 66, and the upper slope 98 of the control piston in the normal, deactivated condition associated with FIG. 4A, FIG. 5B shows the same relationship when the cylinder unit 42 is in the fully retracted limit, condition shown in FIG. 5A.

It can be appreciated that, as between the conditions shown in FIG. 4A and FIG. 5A, the total projection 100 of the first piston 40 relative to the guide body 44 has been to changed to 100', by the distance 110 that the cylinder unit 42 and associated latching balls, have moved downwardly within the guide body 44. It should be appreciated further that in FIG. 5A, the control piston 74 may have bottomed out, but this need not be a hard stop, thereby maintaining resiliency in the relationship between the cylinder spring 84 and the force applied to the cylinder unit of the of the flange or the like at 90.

When normal operation of the lash adjuster is desired, the hydraulic pressure in the secondary gallery 66 is released. The control piston 74 will rise within the secondary cylinder and the cylinder spring will displace the cylinder unit upwardly, until the balls reach the detents and return to the condition shown in FIG. 4A.

In some applications it could happen that while the exhaust valve is deactivated the pressure entering the primary piston assembly via 62, 60, 46 (see FIG. 4A) that provides for normal adjustment of the hard stop could spread the lash adjuster to the point that it would prevent proper reengagement and thus prevent valve reactivation.

Figure 6:
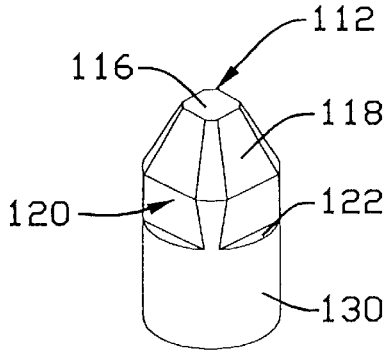
FIG. 6 shows an alternative form of the control piston.
Figure 7:
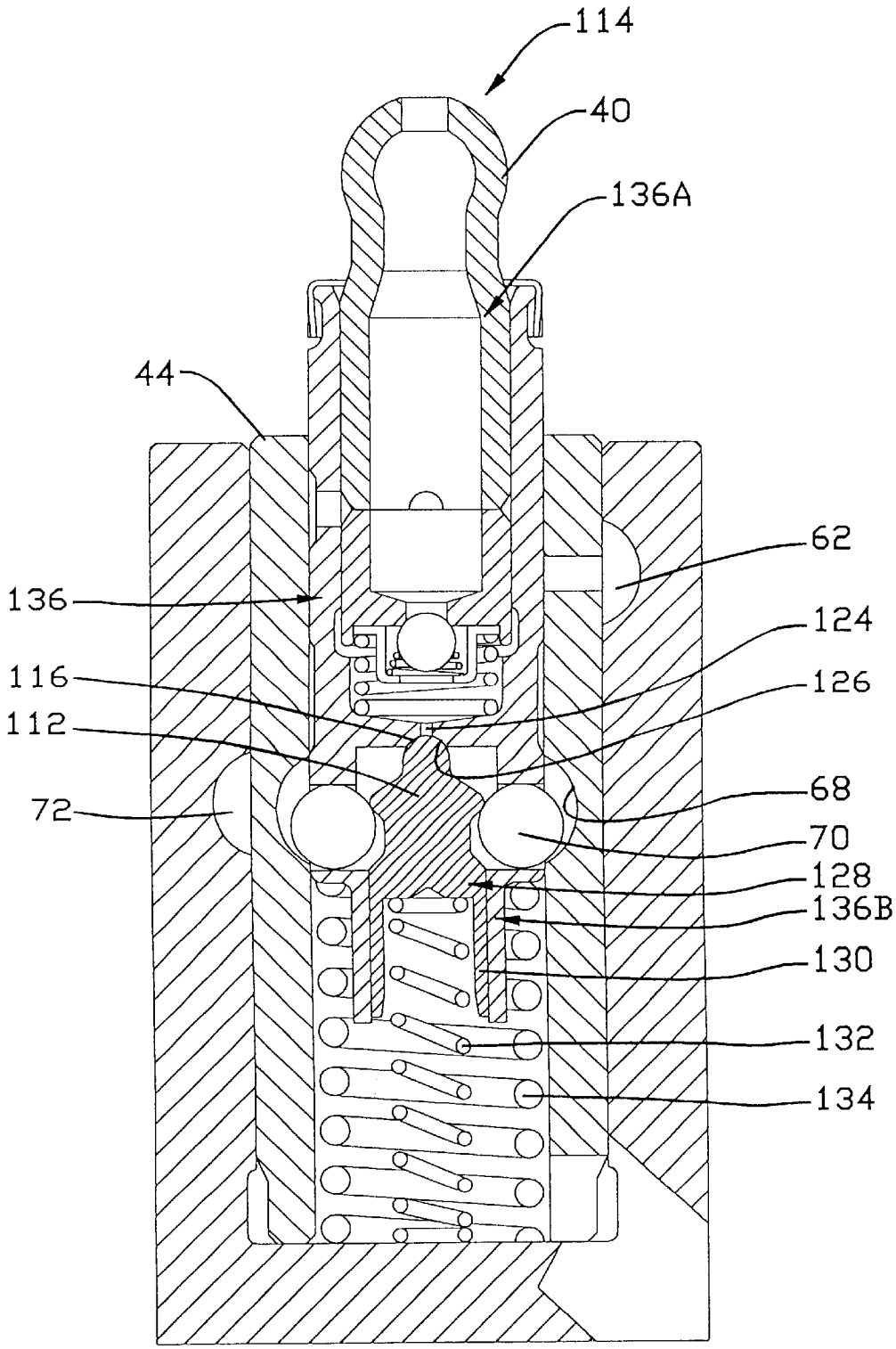
FIG. 7 shows a lash adjuster incorporating the control piston of FIG. 6 (with the ramp angles exaggerated)

FIGS. 6, 7 and 8 show another embodiment 112, 114 incorporating an anti-pump-up device, which should prevent this. The differential hydraulic forces due to pressure/area relationships, can be designed to always have a positive valve closing force component. FIG. 7 shows a lash adjuster incorporating the control piston of FIG. 6 (with the ramp angles exaggerated). The control piston 112 has a rounded top forming a valve seat 116 to be discussed in greater detail below, and upper ramps 118 and lower ramps 120 which form a smaller included angle than the analogous slopes 98 and 96 shown in FIG. 4. In particular, they form an acute angle that is substantially symmetric relative to a plane extending perpendicularly to the device centerline. As with the previous embodiment, the control piston 112 has a substantial cylindrical, hollow body portion 130 extending below the ledge portion 122. As in the previous embodiment, cylinder unit or unitary tappet 136 is situated in a guide body 44, with the cylinder unit defining upper or primary cylinder 136A and lower, or secondary cylinder 136B, with a substantially solid intermediate region in which cross bores intersect at a central control chamber 138.

However, in this embodiment, vent 124 with associated seat 126 is formed in the material web between the first cylinder 136A and the control chamber 138. The head of the control piston 112 forms a valve surface or seat 116 for selectively closing or opening the vent 124. The presence of this vent provides an anti-pump-up feature that prevents the high pressure in the primary cylinder 136A from spreading the walls of the guide body 44 to the extent that it would prevent exhaust valve reactivation.

Figure 8A:
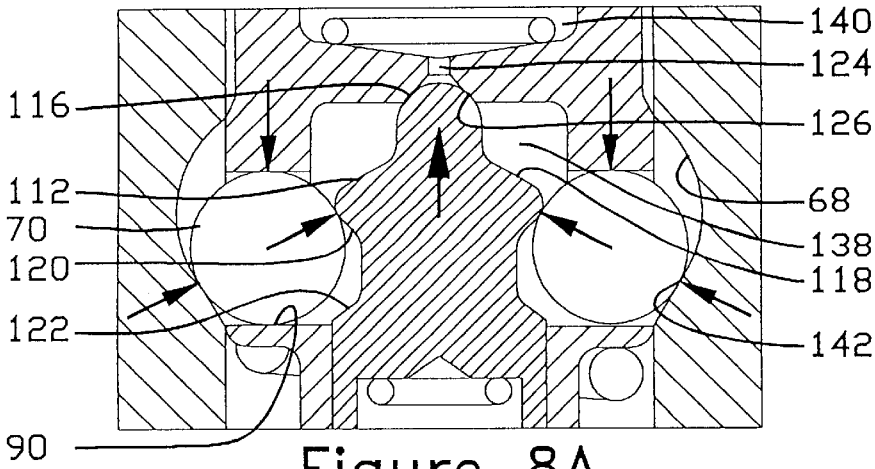
FIGS. 8A–F illustrate the phasing of the tappet deactivation for the embodiment of FIG. 7.
Figure 8B:
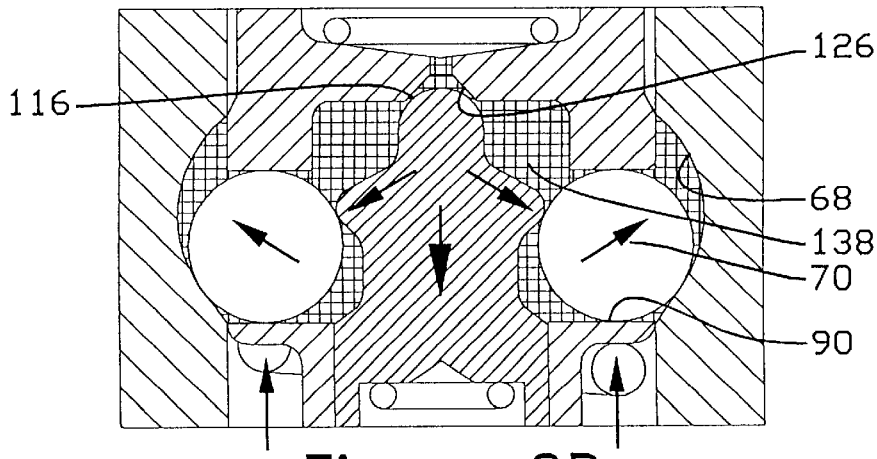

FIGS. 8A–F illustrate the phasing of the deactivation of the cylinder unit or tappet 136 for the embodiment shown in FIG. 7. FIG. 8A corresponds to the operational condition wherein the exhaust valve is active for sequentially opening and closing the exhaust port of the combustion chamber, and the secondary hydraulic circuit is deactivated with respect to the secondary piston assembly. In this operating mode, the force imposed at the top of the primary piston 40 at the pivot surface is transmitted through the primary piston assembly to the latching balls 70 which are trapped against hard stop surface 142. The lower slope 120 of the control piston contacts the blocking balls in this hard stop condition. The force component generated by the exhaust valve actuation reaction force will keep the venting valve 116 closed. It should be appreciated that an alternative to the illustrated one-piece control piston with integral valve 116, could equivalently be implemented using a control piston with captured ball valve member at the top. The lower slopes 120 of the control piston adjacent the apex or hilltop of the acute angle formed by the upper and lower slopes, does not provide a positive downward force against the blocking balls, but rather merely contacts the balls to assure that they maintain their positions laterally outward against the lower curvature 142 of the detents 68 while resting on the shelf 90.

When the secondary oil gallery is pressurized, thereby pressurizing the control chamber 138, the control piston 112 separates from the vent seat 126 and begins moving downwardly against the force of piston spring 132. While the roller of the arm 20 travels on the cam base circle (see FIG. 2), the dominant force acting on the tappet 136 is the upward force of deactivation cylinder spring 134. As the valve 116 cracks open, the high pressure in the primary cylinder 136A collapses, allowing the blocking balls to travel up the lower ramp 120. With the control piston traveling downward, the apex passes the top of hill position 144 shown in FIG. 8C until the blocking balls roll inwardly onto the upper slopes 118 as shown in FIG. 8D. As in the previously described embodiment, the main hydraulic activation for control chamber 138 is pressurization through port 72 by a secondary hydraulic circuit.

Figure 8C:
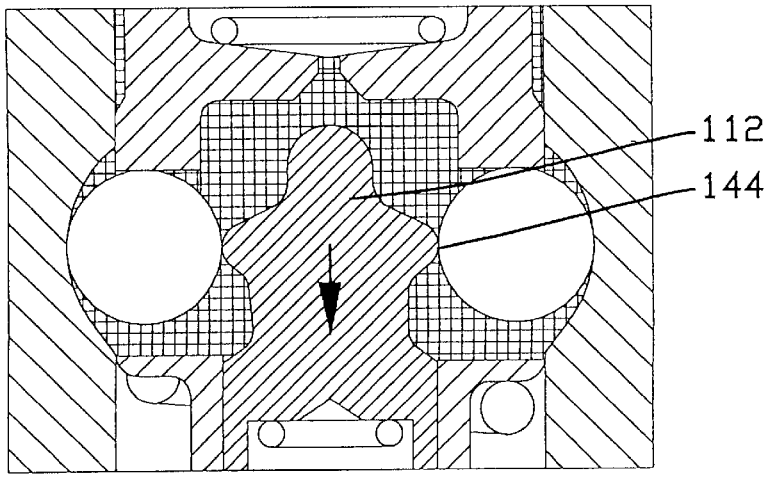
Figure 8D:
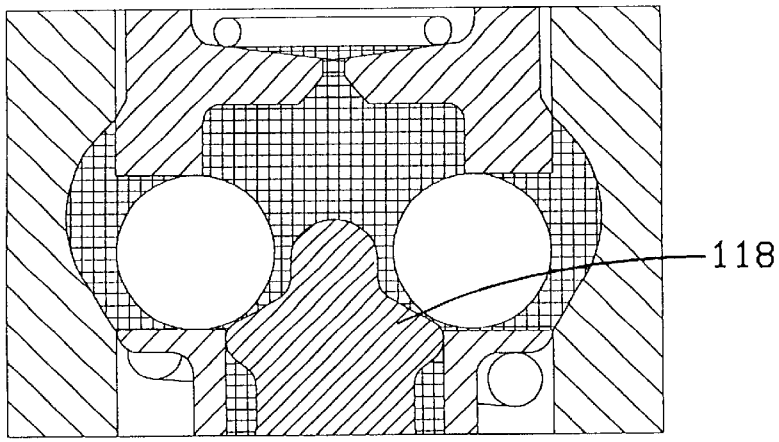

At the condition shown in FIG. 8C, where the balls are at the maximum laterally outward position, the balls at their 3:00 position contact the apex of the control piston angle, and at the 9:00 position contact the surfaces of the detents that are furthest from the device centerline. The actuating pressure keeps the control piston moving downwardly to the position shown in FIG. 8D whereby the balls remain within the diameter of the tappet 136 and the tappet can resiliently accommodate downward forces via cylinder spring 134 to keep the engine valve deactivated.

Figure 8E:
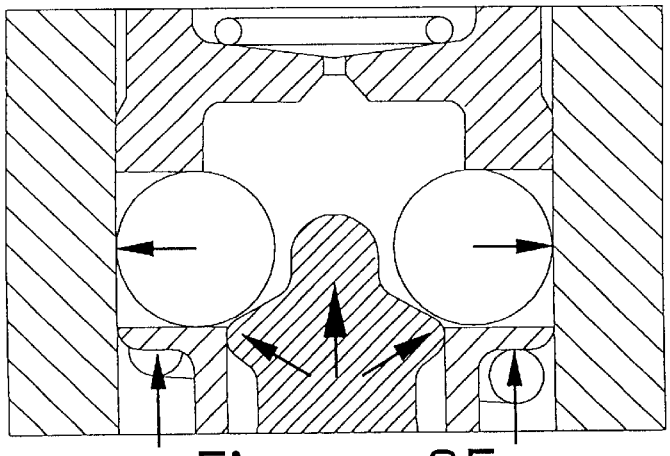
Figure 8F:
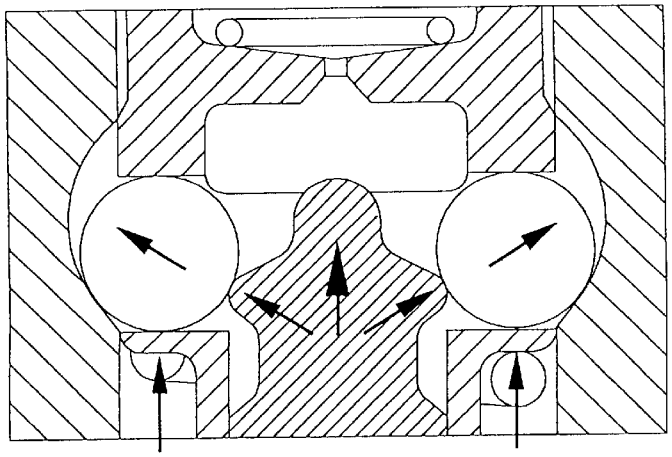

As shown in FIGS. 8E and F, when the pressure in the secondary gallery 138 collapses, the latching piston return spring 132 loads the latching balls against the wall of the guide body. As soon as the tappet 136 reaches the position where the blocking balls register with the detents, the balls will re-engage. The latching piston returned spring is aided by inertia and will thus push the piston through the balls, closing the high pressure chamber venting valve 116. The high pressure chamber in 136A expands, eliminating any residual lash.

What is claimed is:

1. An hydraulic lash adjuster for installation in an internal combustion engine having a combustion cylinder, a cylinder exhaust port formed with a seat, a displaceable exhaust valve situated to open and close the exhaust port by separating from and sealing against said valve seat, a rotatable cam shaft with lobed cam profile for cyclically pivoting a rocker arm on a pivot point of a lash adjuster with sufficient force to displace said valve against the closing force of an associated valve spring and thereby cyclically close and open said exhaust port, wherein said hydraulic lash adjuster comprises:

a cylindrical guide body having an open upper end;

a primary piston assembly situated in the guide body with a primary piston extending upwardly along the guide body axis beyond said open upper end to a pivot surface adapted to provide a pivot point for one end of the rocker arm;

primary hydraulic flow passage means penetrating said guide body and cooperatively associated with the primary piston assembly for adjusting the projection of the pivot surface from the guide body;

a secondary piston assembly situated in the guide body below the primary piston assembly and including a coaxially oriented control piston having a control surface spaced below the primary piston assembly;

secondary hydraulic flow passage means cooperatively associated with the secondary piston assembly, for adjusting the axial position of the control piston;

latch means situated between the primary piston assembly and the secondary piston assembly and cooperating with the control piston such that, when the secondary hydraulic control circuit is deactivated the control piston maintains the latch means in a first position to form a hard stop limit on the displacement of the primary piston assembly relative to the guide body, and when the secondary hydraulic flow passage means is activated with high pressure hydraulic fluid, the control piston is displaced axially and the latch means shifts to a second position whereby the secondary piston assembly cooperates with the primary piston assembly to provide a soft stop for displacement of the primary piston assembly relative to the guide body.

2. The lash adjuster of claim 1, wherein a generally cylindrical tappet is situated in the guide body and biased toward the upper end of the guide body, said tappet having:

an upper portion defining an upper cylinder in which the primary piston is mounted and with said primary piston forming said primary piston assembly;

an intermediate portion partially defining said latch means; and a lower portion defining a lower cylinder in which the control piston is mounted and with said control piston forming said secondary piston assembly;

wherein the control piston is displaceable within said intermediate portion between axially spaced first and second positions, corresponding to said first and second positions of the latch means, and when the control piston and latch means are in the respective second positions, the bias on the tappet provides the soft stop for displacement of the primary piston assembly relative to the guide body.

3. The lash adjuster of claim 2, wherein the latch means includes a plurality of rigid bodies which in the latch means first position are urged transversely to the axis by the control piston first position into engagement with the guide body, and in the control piston second position are displaced transversely to the axis to disengage from the guide body in said second latch position, such that the tappet with primary piston assembly can move axially relative to the guide body to provide said soft stop.

4. The lash adjuster of claim 3, wherein:

the latch means includes a plurality of cross bores in the intermediate portion of the tappet, said bores intersecting along the axis to form a control chamber in which the control piston is situated;

the rigid bodies are spheres situated in and having diameters substantially equal to the diameters of the respective cross bores;

the guide body includes detents on which the spheres are rigidly supported against axial displacement when the latch means and control piston are in the first positions; and said secondary hydraulic flow passage means includes a high pressure flow passage to said control chamber, for displacing the control piston from the first to the second positions, thereby relieving the transverse support provided by the piston on the spheres and retracting the spheres from the detents.

5. The lash adjuster of claim 4, wherein the detents are an annular groove in guide body.

6. The lash adjuster of claim 4, wherein the control piston assembly includes:

a piston having a head in the shape of a compound pyramid situated in the control chamber and bearing upon the spheres, and a hollow body extending axially through the second cylinder;

a piston spring seated in the second cylinder and extending into the piston body for biasing the control piston into the control chamber; and a spring seated between said guide body and said tappet below the cross bores, for providing said bias of the tappet toward the upper end of the guide body.

7. The lash adjuster of claim 6, wherein the head of the control piston has a plurality of lower ramps that transition into a plurality of upper ramps, the ramps having acute slope angles relative to the axis such that the slope angle of the lower ramps is smaller than the slope angle of the upper ramps.

8. The lash adjuster of claim 7, wherein the slope angle of the lower ramps gradually decreases as the lower ramp approaches the upper ramp.

9. The lash adjuster of claim 4, wherein the secondary hydraulic flow passage means includes a flow passage between the primary piston assembly and the secondary piston assembly, and said control piston carries a valve surface for opening said a vent to pressurize the control chamber with hydraulic fluid from said primary piston assembly.

10. The lash adjuster of claim 1, wherein the latch means include a plurality of rigid bodies symmetrically spaced about the axis and guided for radial movement between said first and second positions under the influence the axial movement of the control piston.

11. The lash adjuster of claim 10, wherein the control piston assembly includes:

a piston having a head in the shape of a compound pyramid bearing upon the rigid bodies, and a hollow body extending axially through the second cylinder;

a piston spring seated in the second cylinder and extending into the piston body for biasing the control piston into the control chamber; and a spring seated between said guide body and said tappet below the cross bores, for providing said bias of the tappet toward the upper end of the guide body.

12. The lash adjuster of claim 1, wherein the latch means includes a plurality of rigid bodies which in the latch means first position are urged transversely to the axis by a control piston first position into engagement with the guide body, and in a control piston second position are displaced transversely to the axis to disengage from the guide body in said second latch position, such that the primary piston assembly can move axially relative to the guide body to provide said soft stop.

13. The lash adjuster of claim 1, wherein:

the latch means includes a plurality of cross bores in the intermediate portion of the tappet, and a plurality of rigid bodies, said bores intersecting along the axis to form a control chamber in which the control piston is situated; the rigid bodies being spheres situated in and having diameters substantially equal to the diameters of the respective cross bores;

the guide body includes detents on which the spheres are rigidly supported against axial displacement when the latch means and control piston are in the first positions; and said secondary hydraulic flow passage means includes a high pressure flow passage to said control chamber, for displacing the control piston from the first to the second positions, thereby relieving the transverse support provided by the piston on the spheres and retracting the spheres from the detents.

14. The lash adjuster of claim 4, wherein the detents are an annular groove in guide body.

15. The lash adjuster of claim 14, wherein the secondary hydraulic flow passage means includes a flow passage between the primary piston assembly and the secondary piston assembly, and said control piston carries a valve surface for opening a vent to pressurize the control chamber with hydraulic fluid from said primary piston assembly.

16. In an internal combustion engine having a combustion cylinder, a cylinder exhaust port formed with a seat, a displaceable exhaust valve situated to open and close the exhaust port by separating from and sealing against said valve seat, a rotatable cam shaft with lobed cam profile for cyclically pivoting a rocker arm on a pivot point of a lash adjuster with sufficient force to displace said valve against the closing force of an associated valve spring and thereby cyclically close and open said exhaust port, a method for selectively maintaining the valve closed throughout at least one camshaft rotation cycle, comprising:

supporting the lash adjuster with a plurality of rigid spheres carried by the lash adjuster and urged radially outwardly into engagement with detents in a guide body surrounding the lash adjuster, to prevent relative movement between the lash adjuster and the guide body during normal operation and thus establish a fixed pivot point for one end of the rocker arm; and when said valve closure through at least one camshaft rotation is desired, displacing said hard spheres radially inwardly out of engagement with the detents and supporting the lash adjuster axially by a resilient force that permits the lash adjuster to move axially relative to the guide body and thus provide a soft stop of the arm on the lash adjuster, thereby reducing the leverage the cam lobe cannot apply to the rocker arm for opening said valve against the closing force of said valve and spring.

17. The method of claim 16, wherein the rigid spheres are urged radially outward by a support head centered on the axis and biased axially into contact with the spheres; and the rigid spheres are displaced radially inwardly as a result of hydraulically displacing the support head out of contact with the spheres;

whereby the spheres move radially inward to clear the indents.

18. The method of claim 17, wherein the support head is biased axially by an inner spring seated within the lash adjuster; and the lash adjuster is supported by an outer spring surrounding the inner spring, said outer spring having supported by the guide body and the other end acting on the lash adjuster to provide the resilient force that permits the lash adjuster to move axially relative to the guide body.

* * * * *

UNITED STATES PATENT AND TRADEMARK OFFICE

CERTIFICATE OF CORRECTION

PATENT NO. : 6,732,687 B2
DATED : May 11, 2004
INVENTOR(S) : Djordjevic

It is certified that error appears in the above-identified patent and that said Letters Patent is hereby corrected as shown below:

Column 9,
Line 32, after "opening" delete "said".
Line 65, after "situated" (first occurrence) delete ";" and substitute -- , -- therefore.

Signed and Sealed this

Thirteenth Day of December, 2005

JON W. DUDAS
*Director of the United States Patent and Trademark Office*